US009589424B2

(12) United States Patent
Moody et al.

(10) Patent No.: US 9,589,424 B2
(45) Date of Patent: Mar. 7, 2017

(54) GAMING SYSTEM, GAMING DEVICE AND METHOD FOR DRAW POKER GAME (DREAM CARD)

(71) Applicant: IGT, Las Vegas, NV (US)

(72) Inventors: Ernest W. Moody, Las Vegas, NV (US); Michael W. Wood, Denham Springs, LA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/160,752

(22) Filed: May 20, 2016

(65) Prior Publication Data

US 2016/0267748 A1 Sep. 15, 2016

Related U.S. Application Data

(63) Continuation of application No. 14/834,023, filed on Aug. 24, 2015, now Pat. No. 9,349,257, which is a continuation of application No. 12/946,608, filed on Nov. 15, 2010, now Pat. No. 9,129,485.

(60) Provisional application No. 61/261,366, filed on Nov. 15, 2009.

(51) Int. Cl.
*G07F 17/32* (2006.01)
*A63F 3/00* (2006.01)

(52) U.S. Cl.
CPC ..... *G07F 17/3293* (2013.01); *G07F 17/326* (2013.01); *G07F 17/3211* (2013.01); *G07F 17/3244* (2013.01); *A63F 2003/00861* (2013.01); *G07F 17/3262* (2013.01)

(58) Field of Classification Search
CPC ..... G07F 17/3293; G07F 17/3211; G07F 17/3244; G07F 17/326; G07F 17/3262; A63F 2003/00861
See application file for complete search history.

(56) References Cited

U.S. PATENT DOCUMENTS

| | | | |
|---|---|---|---|
| 5,046,736 | A | 9/1991 | Bridgeman et al. |
| 5,224,706 | A | 7/1993 | Bridgeman et al. |
| 5,823,873 | A | 10/1998 | Moody |
| 6,050,568 | A | 4/2000 | Hachquet |
| 6,343,989 | B1 | 2/2002 | Wood et al. |
| 6,517,074 | B1 | 2/2003 | Moody et al. |
| 6,652,377 | B1 | 11/2003 | Moody et al. |
| 2008/0102913 | A1 | 5/2008 | Schultz |

*Primary Examiner* — Werner Garner
(74) *Attorney, Agent, or Firm* — Neal, Gerber & Eisenberg LLP

(57) ABSTRACT

A gaming system, a gaming machine and a method is provided having a Five Card Video Draw poker game with a single hand or multiple hands. The gaming system or gaming machine first determines whether a dream card is going to be used in a particular round of play or a dream card is used on every hand. If the dream card is going to be used, then the last card of the initial hand is chosen so that, when the last card is combined with the other randomly selected cards of the initial hand, the initial starting hand will have the highest possible expected value.

20 Claims, 7 Drawing Sheets

GAMING SYSTEM, GAMING DEVICE AND METHOD FOR DRAW POKER GAME (DREAM CARD)

PRIORITY CLAIM

This application is a continuation of, and claims priority to and the benefit of, U.S. patent application Ser. No. 14/834,023, which was filed on Aug. 24, 2015, which is a continuation of, and claims priority to and the benefit of, U.S. patent application Ser. No. 12/946,608, which was filed on Nov. 15, 2010, and issued as U.S. Pat. No. 9,129,485 on Sep. 8, 2015, which claims priority to and benefit of U.S. Provisional Patent Application No. 61/261,366, which was filed on Nov. 15, 2009, the entire contents of each of which are incorporated by herein by reference.

This application relates primarily to video poker games, and more particularly to video poker games that are single player games in which a player plays one or more poker hands against a pay table, and not against a dealer's hand. The player attempts to achieve final card combinations that are based on poker hand rankings Prior to the initial hand being dealt, a dream card indicator is activated to determine whether a dream card will be used in that round of play. Then an initial starting hand is displayed. If the dream card is used, the last card of the initial hand is chosen so that, when the last card is combined with the other randomly selected cards of the initial hand, the initial starting hand will have the highest possible expected value. The player is then allowed to discard unwanted cards and to replace the unwanted cards with replacement cards. The final poker hand is compared to a pay table to determine winning and losing hands.

BACKGROUND

Poker is a well known card game that comes in many variations. One of the most common variations of poker is Five Card Draw poker. In general, in Five Card Draw poker, a player receives an initial hand of five cards dealt from a fifty-two card deck of playing cards. A standard deck of playing cards has four suits: Spades, Hearts, Diamonds and Clubs; and each suit has thirteen ranks: Deuce, Three, Four, Five, Six, Seven, Eight, Nine, Ten, Jack, Queen, King, and Ace, in order from lowest to highest.

Once the initial hand is dealt to a player, the player can discard none, one, a plurality, or all of the five cards of the initial hand. Each discarded card is replaced with another card from the remaining cards of the deck. After the replacement, the player then has a final hand and the five cards of the final hand are evaluated for winning combinations.

A feature common to most poker games is that the ranking of the final hands is based on poker hand ranking. For a five card poker game, the poker hand ranking, from highest to lowest by poker hand category, is: Royal Flush, Straight Flush, Four-of-a-Kind, Full House, Flush, Straight, Three-of-a-Kind, Two Pair, One Pair, and Highest Card in Hand.

Within each poker hand ranking category, hands are ranked according to the rank of individual cards, with an Ace being the highest card and a Deuce being the lowest card. There is no difference in poker hand ranking between the four suits of cards.

Numerous variations of poker exist, including Five Card Draw poker, Five Card Stud poker, Seven Card Stud poker, Hold 'Em poker (also called Texas Hold 'Em poker), Omaha poker (also called Omaha Hold 'Em poker), and Pai-Gow poker. The variations in these games generally differ in the manner in which cards are dealt and in the manner and frequency in which bets are placed. The number of cards dealt and the ability to draw or replace cards depends on the particular variation of poker being played. Various criteria may also be used to determine the winning hand, including highest ranking hand, lowest ranking hand (Lo-Ball), and those games in which the high and low hands each win half of the pot (High-Low).

Video-based Five Card Draw poker has proven to be a very popular wagering game. Typically, video poker games that are single player games in which a player plays one or more poker hands against a pay table, and not against a dealer's hand. The player attempts to achieve final hand card combinations that are based on poker hand rankings Typically an initial hand is dealt to the player and the player is allowed to discard unwanted cards and to replace the unwanted cards with replacement cards. The final poker hand is compared to a pay table to determine winning and losing hands.

The conventional winning poker hand rankings that are used in video poker in order from highest to lowest by poker hand category are: Royal Flush, Straight Flush, Four of a Kind, Full House, Flush, Straight, Three of a Kind, Two Pair and a Pair of Jacks or Better. Any hand having less than a Pair of Jacks or Better is a losing hand. These winning poker hand ranking categories are used in the Jacks or Better Draw poker format as well as many of the other draw poker formats.

Any suitable pay table can be used, and a typical pay table for a Jacks or Better Draw poker format return would be:

TABLE 1

JACKS OR BETTER DRAW POKER

| | NUMBER OF COINS BET | | | | |
|---|---|---|---|---|---|
| POKER HAND CATEGORY | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Video poker as a draw poker game using the Jacks or Better Draw poker format has been played in gaming casinos for many years. Variations of video draw poker using formats other than Jacks or Better have evolved and include video draw poker using Jokers as wild cards and video draw poker using Deuces (or even other cards, such as Sevens) as wild cards. Most of the more recent modifications to video draw poker involve the use of different draw poker formats such as Bonus Poker, Double Bonus Poker, Double-Double Bonus Poker and even Triple Bonus Poker. Different draw poker formats involve changes to the pay table and often involve using different poker hand rankings as winning hand combinations.

Many video poker gaming machines are provided with a menu so that the player can indicate his choice of the poker game format that the player wishes to play and the player then makes his wager based on upon that choice of poker game format. Each poker format has its own pay table associated therewith.

Newer video poker gaming machines allow the player to play multiple hands of video poker at the same time. For example, U.S. Pat. No. 5,823,873 (Moody) (the disclosure of which is incorporated herein by this reference) describes a video gaming machine and method in which the player may play multiple hands at the same time. The player makes a wager for each separate hand to be played by the player. A first initial hand of five cards is dealt all face up. The player selects none, one, a plurality or all of the face up cards from the first hand as cards to be held. The cards that are held are reused from the first hand into all of the other hands. Replacement cards for the non-selected cards are dealt into the first hand so that the first hand has five cards. Additional cards are also dealt to all of the other hands so that each hand is a final five card hand. The poker hand ranking of each final five card hand is determined. The player is then paid for any winning poker hands based on a pay table and the amount of the player's wager.

Another method of playing multiple hand video poker is described in U.S. Pat. No. 6,050,568 (Hachquet) (the disclosure of which is incorporated herein). In this method, two or more identical starting hands are displayed to the player. The player has the option of holding and discarding from each of these hands independently. The player is not required to hold the same cards in each hand. After the player has selected which cards to hold in each hand, replacement cards are displayed for the unheld cards and the poker hand ranking of each final hand is determined. Winning poker hand combinations are paid in accordance with a pay table and the amount wagered by the player.

U.S. Pat. No. 6,517,074 (Moody et al.), the disclosure of which is incorporated herein, also discloses a method of playing multiple hand video poker in which each hand is played independently of the other hands.

U.S. Pat. No. 6,652,377 (Moody et al.), the disclosure of which is incorporated herein, also discloses a method of playing multiple hand video poker in which the displayed cards are shown in a 5×3 matrix and the various five card hands are formed by pay lines similar to the pay lines that are used in a slot machine game.

In typical video-based Five Card Draw poker games, a player receives five cards from a virtual deck of playing cards to form an initial player hand. The virtual deck of playing card replicates a traditional fifty-two card deck of playing cards. The player is able to discard none, any, or all of the cards and the replacement cards for the discarded cards are drawn and displayed from the remaining cards of the virtual deck of cards. In a Five Card Draw poker game, a player selects a hold input associated with a particular card to signify that they would like to keep that card. Any cards that are unheld are discarded. The discarded cards are replaced with cards from the remaining cards in the virtual deck to form the final player hand. The final player hand is compared to a pay table and the gaming system provides awards for a winning final hand based on the poker hand ranking of the player's final hand and the amount wagered.

Other variations of Five Card Draw poker exist which use jokers or wild cards, such as Deuces Wild poker and Jokers Wild poker. In Deuces Wild poker, any deuce in a player's hand functions as a wild card. Typically in Jokers Wild poker, when one or more jokers are added to a fifty-two card deck of cards, each joker also acts as a wild card.

It is well known how to calculate the highest Expected Value (EV) for each starting hand dealt to the player. In one embodiment, U.S. Pat. No. 6,343,989 (Wood et al.) a detailed discussion of determining the Expected Value of each initially dealt hand is described. The disclosure of this patent is incorporated herein by this reference.

A player makes a wager, determines the number of hands the player wishes to play and a first starting five card video poker hand is displayed to the player to be played against a preselected video poker game format. The computer controls of the gaming machine calculate the Expected Value (EV) for the five card hand displayed.

SUMMARY

A gaming system, a gaming machine and a method is provided having a Five Card Video Draw poker game with a single hand or multiple hands. The gaming system or gaming machine first determines whether a dream card is going to be used in a particular round of play. If the dream card is going to be used, then the last card of the initial hand is chosen so that, when the last card is combined with the other randomly selected cards of the initial hand, the initial starting hand will have the highest possible expected value.

The gaming system or gaming machine causes an initial five card hand to be dealt to the player face-up. The player then chooses none, one, a plurality, or all of the initial five cards as cards to discard. If multiple hands of poker are being played, then each card that is held is then duplicated into all of the other hands to be played. Replacement cards for the unheld cards are displayed and each hand is completed to have a final five card hand. The poker hand ranking of each final five card hand is determined and winning hands receive an award.

DETAILED DESCRIPTION

Figure 1:
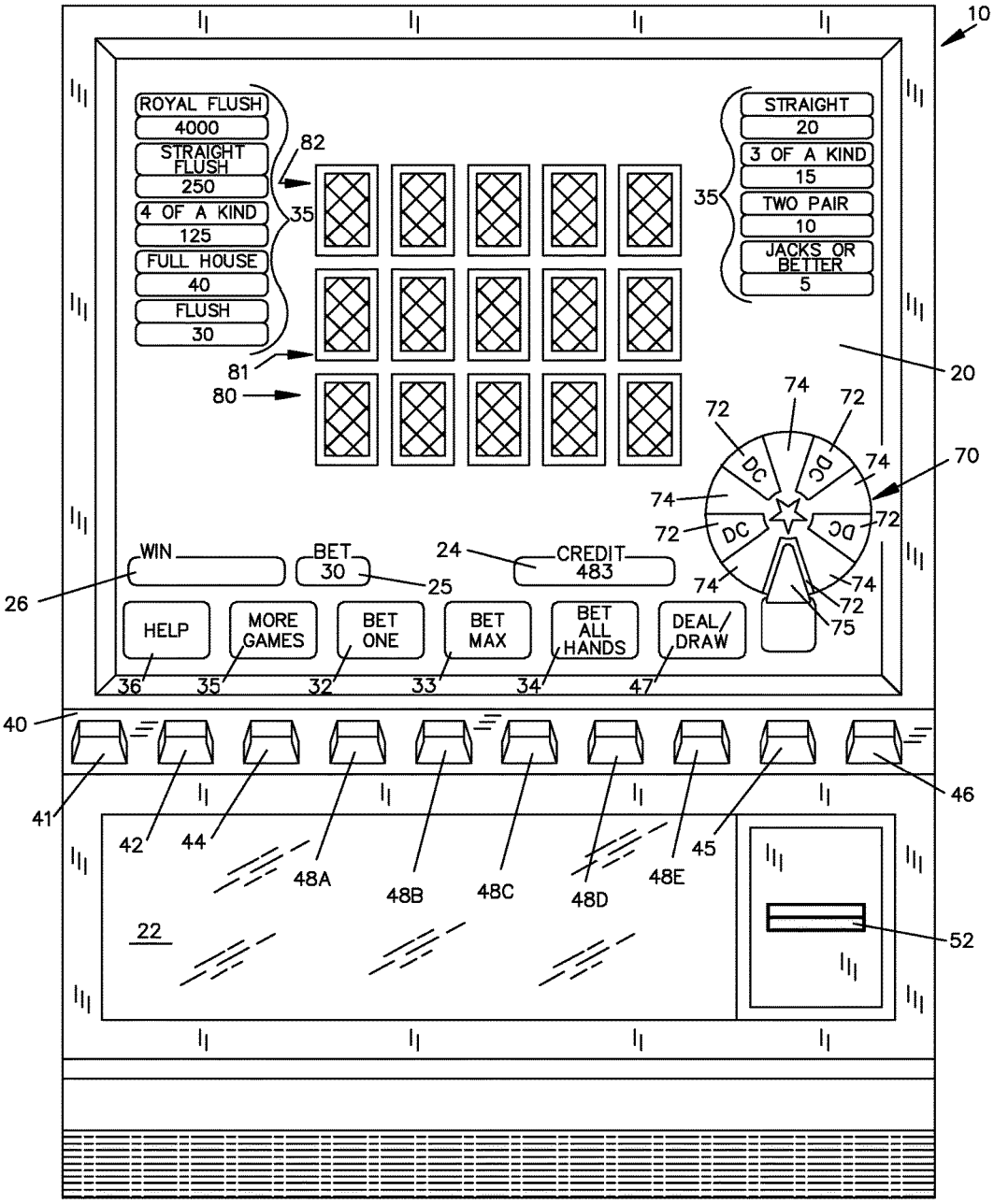
FIG. 1 is a front view of one embodiment of a gaming device of the present disclosure.

Various embodiments of the present disclosure relate to a gaming system or a gaming machine for providing a Five Card Video Draw poker game, and methods of playing and operating a Five Card Video Draw poker game at a gaming table or through a gaming device. Although Five Card Video Draw poker is used in several examples described below, it should be appreciated that the embodiments are not limited to Five Card Video Draw poker and may include other suitable video based cards games or even other video-based games.

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment, and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment.

Gaming machine manufacturers, such as IGT of Reno, Nev., implement these various configurations for gaming machines, gaming devices and gaming systems in various embodiments.

In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player.

In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Referring now to the drawings, FIG. 1 shows a gaming device 10. In the embodiment illustrated in FIG. 1, gaming device 10 has a support structure, housing, or cabinet which provides support for a plurality of displays, inputs, controls, and other features of a conventional gaming machine. It is configured so that a player can operate it while standing or sitting. The gaming device 10 can be positioned on a base or stand or can be configured as a pub-style table-top game (not shown) which a player can operate preferably while sitting. The gaming device 10 may have varying cabinet and display configurations.

Figure 2A:
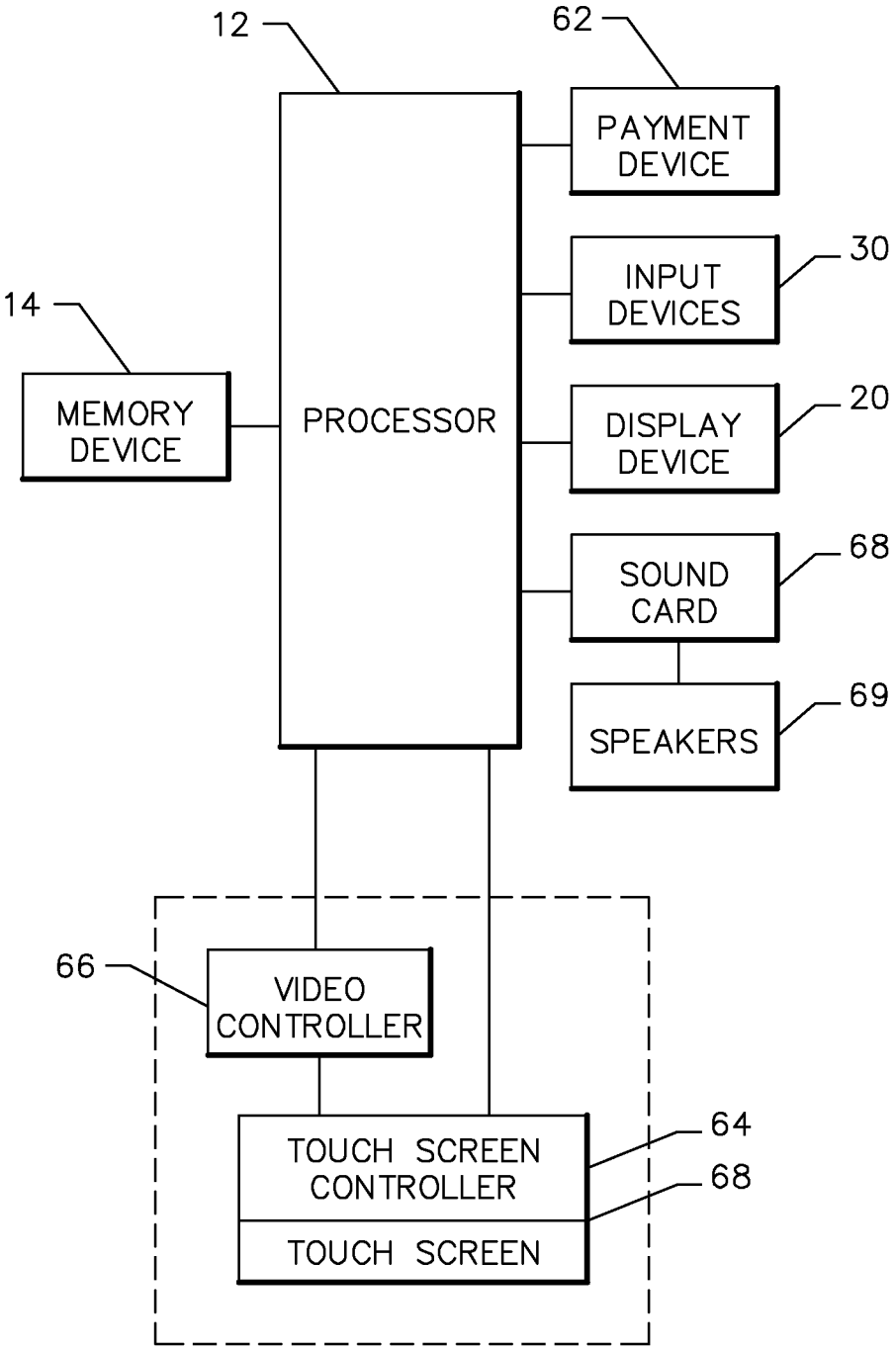
FIG. 2A is a schematic diagram of the electronic configuration of one embodiment of a gaming device of the present disclosure.

In one embodiment, as illustrated in FIG. 2A, the gaming device 10 preferably includes at least one processor 12, such as a microprocessor, a microcontroller-based platform, a suitable integrated circuit or one or more application-specific integrated circuits (ASIC's). The processor 12 is in communication with or operable to access or to exchange signals with at least one data storage or memory device 14. In one embodiment, the processor 12 and the memory device 14 reside within the cabinet of the gaming device. The memory device 14 stores program code and instructions, executable by the processor, to control the gaming device 10. The memory device 14 also stores other data such as image data, event data, player input data, random or pseudo-random number generators, pay-table data or information, and applicable game rules that relate to the play of the gaming device 10. In one embodiment, the memory device 14 includes random access memory (RAM): which can include non-volatile RAM (NVRAM), magnetic RAM (MRAM), ferroelectric RAM (FeRAM), and other forms as commonly understood in the gaming industry. In one embodiment, the memory device 14 includes read only memory (ROM). In one embodiment, the memory device 14 includes flash memory and/or EEPROM (electrically erasable programmable read only memory). Any other suitable magnetic, optical, and/or semiconductor memory may operate in conjunction with the gaming device 10 disclosed herein.

In one embodiment, part or all of the program code and/or operating data described above can be stored in a detachable or removable memory device including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor 12 and memory device 14 may be collectively referred to herein as a "computer" or "controller."

In one embodiment, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In one embodiment, as illustrated in FIG. 1, the gaming device 10 includes one or more display devices 20 controlled by the processor. The display devices are preferably connected to or mounted in or on the cabinet of the gaming device 10. The embodiment shown in FIG. 1 includes a central display device 20 which displays a primary game. This display device may also display any suitable secondary game associated with the primary game as well as information relating to the primary or secondary game. In the embodiment shown in FIG. 1, a second display device 22 may also serve as digital or non-digital glass operable to advertise games or other aspects of the gaming establishment. In an embodiment, additional display devices may also be used as digital or non-digital glass to display other game play or game information.

As seen in FIG. 1, in one embodiment, the gaming device includes a credit display 24 which displays a player's current number of credits, cash, account balance, or the equivalent. In one embodiment, the gaming device includes a bet display 25 which displays a player's amount wagered. In one embodiment, the gaming device includes a WIN display location 26 which displays a player's amount won on any particular round of play of the game.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

As illustrated in FIG. 2A, in one embodiment, the gaming device 10 includes at least one payment device 62 in communication with the processor 12. As seen in FIG. 1, a payment device such as a payment acceptor includes a note, ticket or bill acceptor 52 wherein the player inserts paper money, a ticket, or voucher and a coin slot (not shown) where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data), and other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor 12 determines the amount of funds entered and displays the corresponding amount on the credit display 24 or other suitable display as described above.

As seen in FIG. 2A, in one embodiment, the gaming device 10 includes at least one and preferably a plurality of input devices 30 in communication with the processor 12. As shown in FIG. 1, all or a portion of the video screen 20 may be provided as a touch screen which allows the player to effect various actions by touching the associated location on the touch screen. Additionally, buttons for performing various actions can located on the button panel 40 of the gaming machine 10.

The input devices can include any suitable device which enables the player to produce an input signal which is received by the processor 12. In one embodiment, after appropriate funding of the gaming device, the input device is a game activation device as shown in FIG. 1, such as a DEAL/DRAW button 46, a DEAL/DRAW touch screen location 47 or a pull arm (not shown) which is used by the player to start any primary game or sequence of events in the gaming device. The input device can also include any suitable play activator such as a BET ONE button 44 or a BET ONE touch screen location 32, a BET MAX button 45 or a BET MAX touch screen location 33, or a BET ALL HANDS touch screen location 34. The input device can also include a MORE GAMES touch screen location 35 which the player would activate when the player wishes the processor 12 to cause to be displayed on the video screen 20 a different display that allows the player to select from among a plurality of draw poker formats or even other wagering games that can be played. Also, a HELP touch screen location 36 and a HELP button 42 can be provided so that such an input would cause the processor 12 to summon assistance for the player from the gaming establishment. Any suitable combination, arrangement, or configuration of touch screen locations and buttons can be used.

In an embodiment, the button panel 40 is also provided with five "CARD" buttons 48A, 48B, 48C, 48D and 48E associated with each horizontal card location on the video screen 20: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location. These card buttons 48 are used for indicating which cards the player wishes to hold during the play of the game. In another embodiment, the player may simply touch the card location on the video touch screen 20 to cause that card to be held. The use of both card buttons and touch screen locations may be active at the same time on the gaming device 10.

In one embodiment, upon appropriate funding, the gaming device begins the game play automatically. In another embodiment, upon the player engaging one of the play buttons, the gaming device automatically activates game play.

In one embodiment, the player places a bet by pushing the BET ONE button 44 or BET ONE touch screen location 32. The player can increase the bet by one credit each time the player pushes the BET ONE button 44 or BET ONE touch screen location 32. When the player pushes the BET ONE button 44 or BET ONE touch screen location, the number of credits shown in the credit display 24 preferably decreases by one, and the number of credits shown in the bet display 25 preferably increases by one. In another embodiment, the BET MAX button 45 or the BET MAX touch screen location 33 enables the player to bet the maximum wager permitted for a game of the gaming device.

In one embodiment, one input device is a CASH OUT button 41. The player may push the CASH OUT button 41 and cash out to receive a cash payment or other suitable form of payment corresponding to the number of remaining credits. In one embodiment, when the player cashes out, a payment device, such as a ticket, payment, or note generator (not shown) prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card, may be implemented in accordance with the gaming device disclosed herein.

In one embodiment as mentioned above and as seen in FIG. 2A, one input device is a touch-screen 68 coupled with a touch-screen controller 64 or some other touch-sensitive display overlay to allow for player interaction with the images on the display. The touch-screen and the touch-screen controller are connected to a video controller 66. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 68 which function in conjunction with the processor. In one embodiment, the sound generating device includes at least one and preferably a plurality of speakers 69 or other sound generating hardware and/or software for generating sounds, such as by playing music for the primary and/or secondary game or by playing music for other modes of the gaming device, such as an attract mode. In one embodiment the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera in communication with the processor 12 (and possibly controlled by the processor 12), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video slot machines, video blackjack games, video keno, video bingo or any other suitable primary or base game may be implemented.

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unheld or discarded cards are removed from the display and the gaming machine deals the replacement cards from the remaining cards in the deck. This results in a final five-card hand. The gaming device compares the final five-card hand to a pay table which utilizes poker hand rankings to determine the winning and losing final hands. The gaming device provides the player with an award based on a winning hand and the number of credits the player wagered and the pay table.

In another embodiment, the base or primary game may be a multi-hand version of video poker. In this embodiment, the player selects the number of hands the player wishes to play and the player makes a wager for each hand that the player plays. The gaming device deals a first initial hand of five cards all face up to a player. The player selects none, one, a plurality or all of the face up cards from the first hand as cards to be held. The cards that are held are duplicated or reused from the first hand into all of the other hands. The non-selected cards are discarded and replacement cards for the non-selected cards from the remaining cards in the deck are dealt into the first hand so that the final first hand has five cards. Additional cards are also dealt to all of the other hands so that each hand is a final five card hand. The poker hand ranking of each final five card hand is determined. The player is then paid for any winning poker hands based on a pay table and the amount of the player's wager.

In one embodiment, the replacement cards for each hand are dealt from a depleted deck of forty-seven cards (which represent the remaining forty-seven cards from the original fifty-two card deck after the five cards of the initial hand have been removed). Thus in completing each hand, the replacement cards are randomly selected from the remaining forty-seven cards. In one embodiment, the cards of the depleted forty-seven card deck are virtually reshuffled electronically before the replacement cards are dealt to complete each hand.

In one embodiment, in addition to winning credits or other awards in a base or primary game, the gaming device may also include a feature in which a dream card is used during the play of the primary or base game. In one embodiment, the dream card is used during every play of the primary or base game. A player may or may not be required to make an extra or larger wager when the dream card feature is used.

In one embodiment, the dream card may not be used during every play of the primary or base game. The gaming system or gaming machine first determines whether a dream card is going to be used in a particular round of play. If the dream card is going to be used, then the last card of the initial hand is chosen so that, when the last card is combined with the other randomly selected cards of the initial hand, the initial starting hand will have the highest possible expected value. A player may or may not be required to make an extra or larger wager when the dream card feature is used.

In one embodiment, whether a dream card is used is made on a random basis. The criteria for when a dream card is selected is programmed and stored in the memory device 14 and at the beginning of each round of play of the game the processor 12 in conjunction with the memory device 14 causes the display device 20 to show whether a dream card is being used. In one embodiment, the representation of a spinning wheel 70 is shown on the video screen 20. The spinning wheel 70 is divided into a plurality of segments: some the segments 72 are marked with a DC marking (meaning dream card) and some of the segments are marked in blank 74 The processor causes the spinning wheel 70 to rotate and then stop with an indicator 75 overlying one of the segments 72 or 74. If the indicator 75 overlies a DC segment 72, then a dream card is used in that particular round of play. If the indicator 75 overlies a blank segment 74, then no dream card is used in that particular round of play.

In one embodiment, the segments 72 and 74 could have an equal probability of being selected in any particular spin of the wheel 70. In another embodiment, the probability of a DC segment 72 being selected could be either higher or lower than the probability of a blank segment 74 being selected. Any suitable criteria could be used to determine the respective probabilities, such as the amount wagered by the player.

In one embodiment, no separate entry fee or buy-in for the dream card feature is needed. That is, a player may not be required to purchase entry to be eligible for the dream card feature. In another embodiment, qualification of the dream card feature is accomplished by the player making a separate side or additional wager in a designated amount in the primary game to qualify for the dream card feature, including how often the dream card is selected for a particular round of play.

This use of a spinning wheel 70 to display to the player whether or not the dream card feature is being used in any particular round of play is only an example. Other ways of displaying whether or not the dream card feature is being used in any particular round of play can be used, such as a steady, flashing or blinking light indicator, with or without an associated audible tone.

Figure 2B:
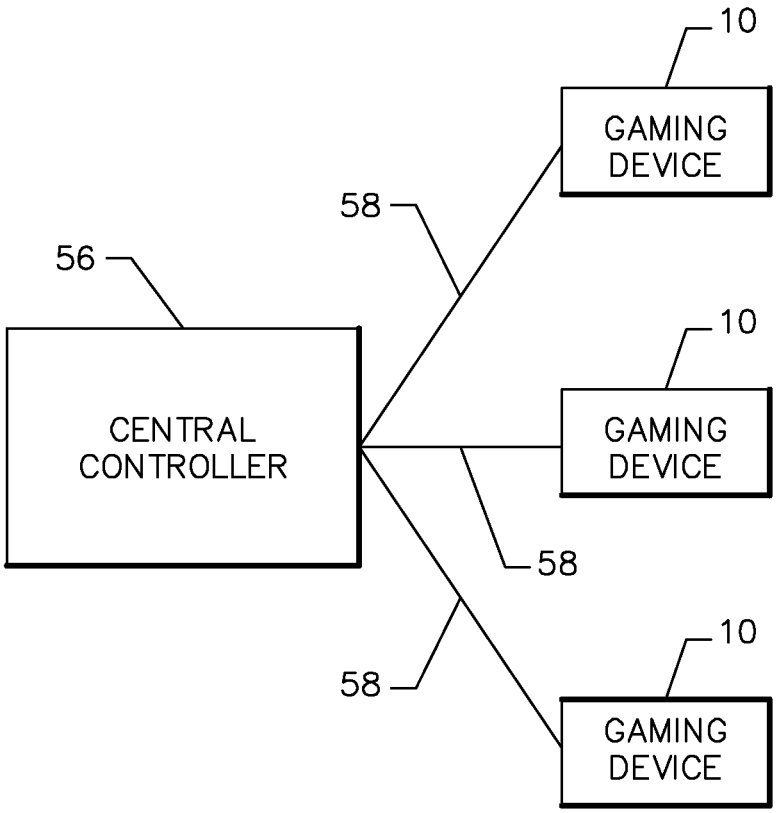
FIG. 2B is a schematic diagram of a gaming system including the data network to which one or more of the gaming devices of the present disclosure may be connected.

In one embodiment, as illustrated in FIG. 2B, a gaming system comprises one or more of the gaming devices 10 which are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or central controller and provided to the player at the gaming device. In this embodiment, each of a plurality of such gaming devices are in communication with the central server or central controller. Upon a player initiating game play at one of the gaming devices, the initiated gaming device communicates a game outcome request to the central server or central controller.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, the gaming system comprises one or more of the gaming devices which are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified players gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display which can be shown on the video screen 20 or provided at any other suitable location on the gaming machine 10. In another embodiment, such tracked information and/or any suitable feature associated with the player tracking system is displayed via one or more service windows which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven or card-driven trigger. In other embodiments, the progressive award triggering event or qualifying condition may be achieved by exceeding a certain amount of game play (such as number of games, number of credits, or amount of time), or reaching a specified number of points or credits earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Five Card Draw Poker Game Embodiments

In one embodiment, the gaming system or gaming device provides a draw poker game which allows a single player to play a card game having one or multiple hands. If multiple hands are used, the player can select how many multiple hands the player wishes to play or the number of multiple hands are designated by the gaming processor 12.

As shown in FIG. 1, the gaming machine 10 has been configured to allow the player to play three hands. In one embodiment, the three hands are displayed on the video screen 20 as HAND ONE 80, HAND TWO 81 and HAND THREE 82.

If a card game having only one hand is being played, then only HAND ONE 80 is used.

The memory device 14 has been programmed to include a pay table 35 which can be displayed on the video screen 20. Various poker hand ranking categories are shown with their associated awards. In the example shown in the drawings, a standard fifty-two card deck of playing cards is used and the Jacks or Better poker format is used for the draw poker game.

Using any of the suitable input devices, such as the BET ONE location 32 or the BET MAX location 33, the player inputs a wager. The memory device 14 contains instructions which are used by the processor 12 to allocate the wager among the number of hands which the player selects to play. Also, using any of the suitable input devices, such as the BET ALL HANDS location 34, the BET ONE HAND location 35 or the BET FIVE HANDS location 36, the player selects the number of hands that the player wishes to play.

In the example shown in the drawings, the player has selected to play all three hands. The wager would be five credits on each of the three hands against the pay table and an additional five credits on each of the three hands for the dream card feature to be active for this particular round of play for a total wager of thirty credits.

After the player has made his wager and selected the number of hands he wishes to play, in one embodiment, the processor 12 in conjunction with the memory device 14, causes the spinning wheel 70 to display whether or not this round of play will have use the dream card feature. As shown in FIG. 1, a dream card segment 72 stops aligned with the indicator 75 so that the dream card feature is being used in this round of play. If a blank segment 74 had stopped aligned with the indicator 75, then the dream card feature would not be used in that round of play and the poker game would play out that round of play in a conventional manner.

Figure 3:
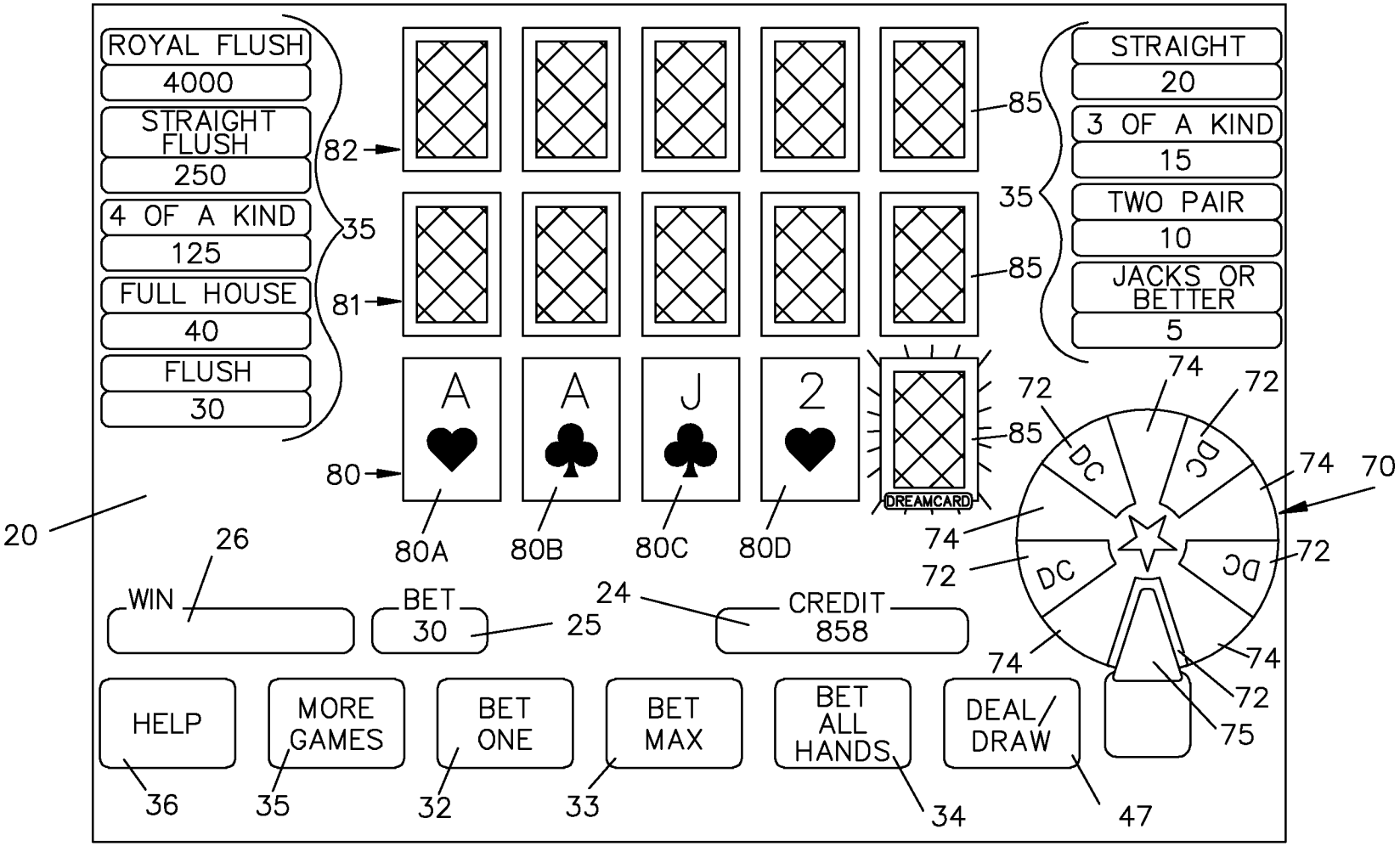
FIGS. 3, 4, 5, and 6 are illustrations of screen displays for the game play of one embodiment of the present disclosure.

Now that the dream card feature has been activated for this round of play, the player inputs using the DEAL/DRAW location 31 or the DEAL/DRAW button 46 to start the play of the hands. The memory device 14 in conjunction with the processor 12 causes the display device 20 to display the first four cards of the first initial first hand 80 which are shown face up. Only the first four cards of the first hand 80 are displayed since the fifth card will be the dream card 85 and will be selected as discussed below. As shown in the example in FIG. 3, the first four cards of the initial first hand 80 is the Ace of Hearts 80A, the Ace of Clubs 80B, the Jack of Clubs 80C, and the Deuce of Hearts 80D.

Because the dream card feature is active for this round of play, the dream card 85 is now selected. The dream card 85 is that card of the remaining forty-eight cards that will give the player a five card initial hand 80 having the highest expected value. The remaining forty-eight cards constitute a first depleted deck which is the initial fifty-two card deck less the first four cards of the initial first poker hand 80.

Figure 4:
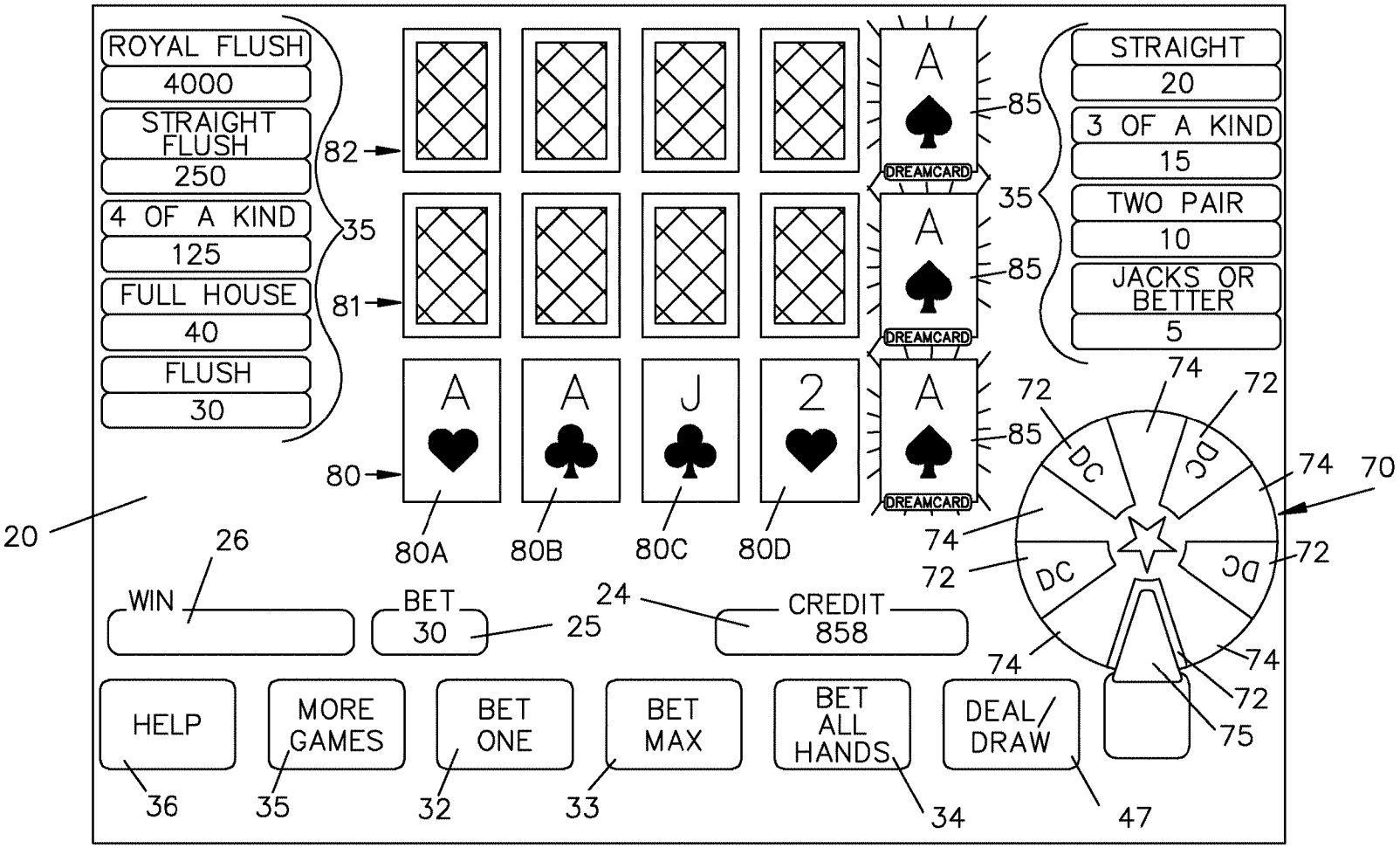

It is well known how to calculate the highest Expected Value (EV) for any five card hand. As explained in U.S. Pat. No. 6,343,989 (Wood et al.), the Expected Value of the initial four cards dealt coupled with each of the remaining forty-eight cards is calculated by the computer. The fifth card that gives the highest Expected Value for the initial five card hand is selected and displayed by the processor 12 as card 85 in the first hand 80. In the example shown in FIG. 4, the dream card 85 is the Ace of Spades (or could also be the Ace of Diamonds).

Figure 5:
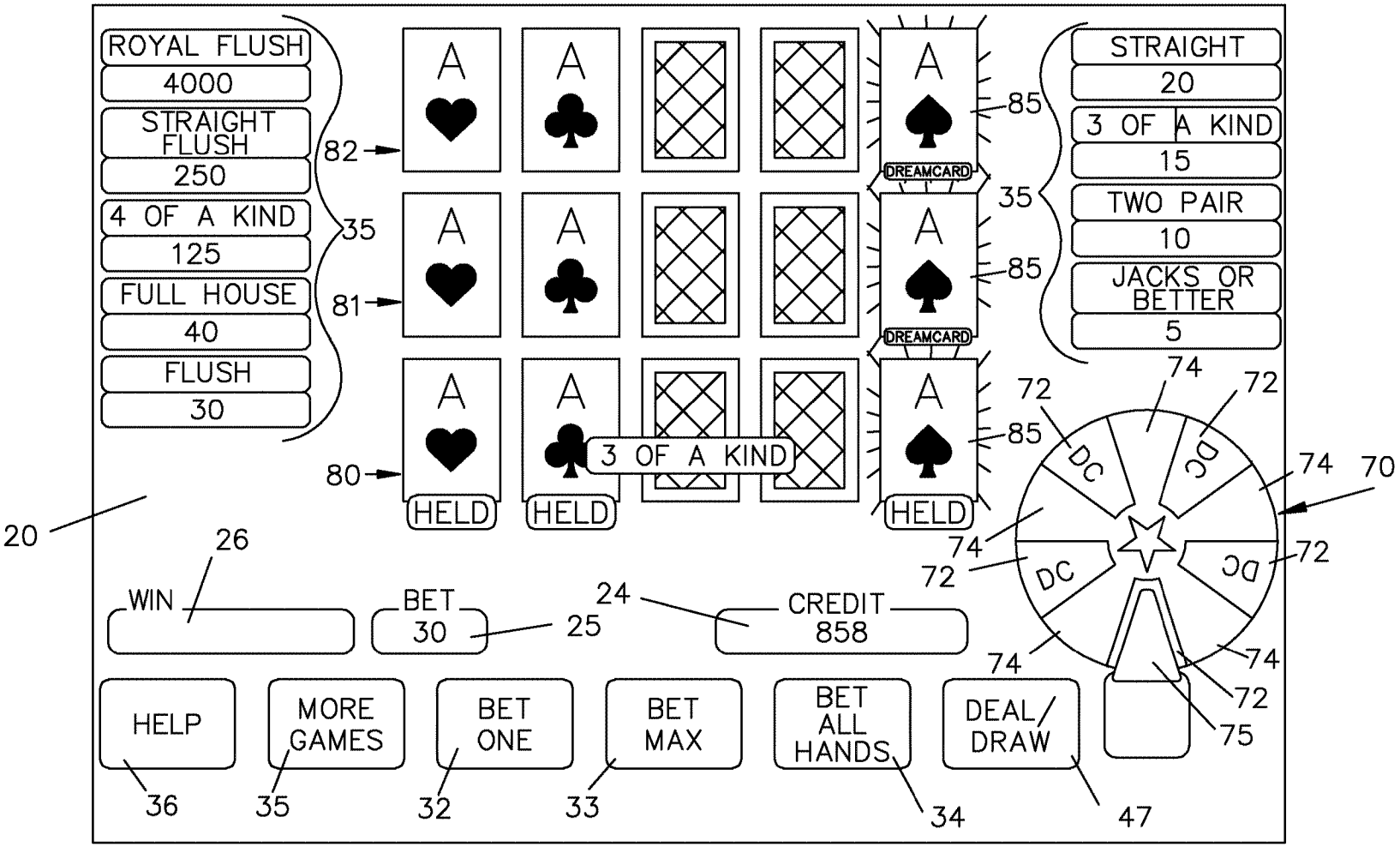

Using a suitable input device, such as the buttons 48 or the touch screen card locations, the player selects none, one, a plurality or all of the cards 80A, 80B, 80C, 80D, and 85 from the initial first hand as cards to be held. As shown in FIG. 5, the player has selected the Ace of Hearts 80A, the Ace of Clubs 80B and the Ace of Spades 85 as the cards to be held.

In response to the player's selection of the card to be held, the processor 12 causes the cards selected to be held from the initial first hand to be automatically duplicated into each of the additional hands as shown in FIG. 5. Also, the card not selected to be held in the initial first hand are discarded as shown in FIG. 5.

The processor 12 in conjunction with the memory device 14 causes replacement cards to be displayed face up into the first hand resulting in a final first hand 180. In the example shown in FIG. 6, the final first hand 180 comprises the Ace of Hearts, the Ace of Clubs, the Six of Hearts, the Seven of Spades, and the Ace of Spades which has a poker hand ranking category of Three-of-a-Kind.

Figure 6:
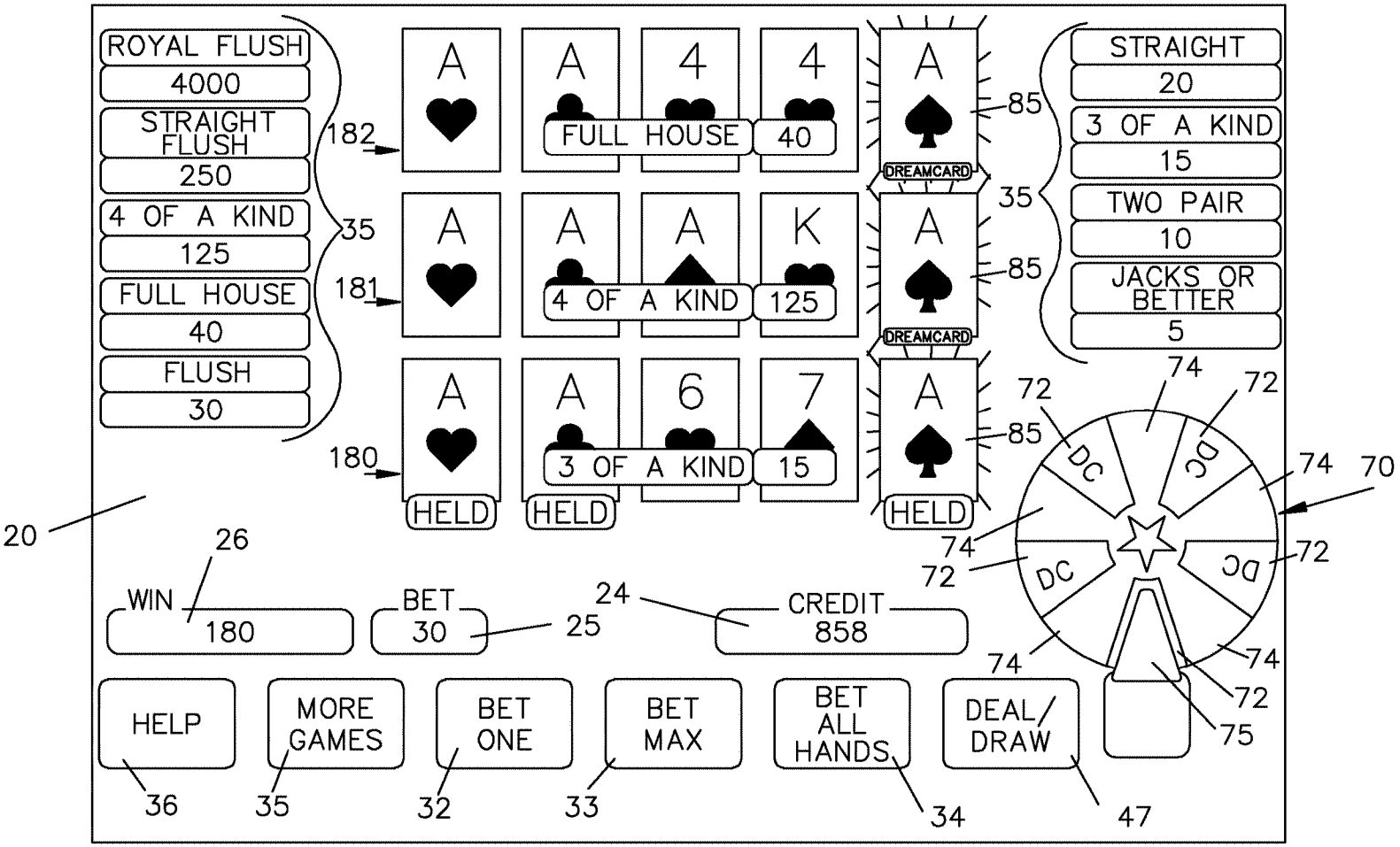

The processor 12 in conjunction with the memory device 14 also causes additional face up cards to be displayed to complete each additional hand forming final additional hands. FIG. 6 shows an example of final HAND TWO 181 resulting in a Four-of-a-Kind and final HAND THREE 182 resulting in a Full House.

In one embodiment, the replacement cards for each hand are dealt from a depleted deck of forty-seven cards (which represent the remaining forty-seven cards from the original fifty-two card deck after the five cards of the initial hand have been removed). This forty-seven card deck constitutes the second depleted deck. Thus in completing each hand, the replacement cards are randomly selected from the remaining forty-seven cards. In one embodiment, the cards of the depleted forty-seven card deck are virtually reshuffled electronically before the replacement cards are dealt to complete each hand.

The processor 12 in conjunction with the memory device 14 determines the poker hand ranking of the final first hand and each final additional hand. Using any suitable pay table 35, such as Table 1, the processor 12 displays an award if the final first hand 180 is a winning hand according to the pay table 35. Also, the processor 12 in conjunction with the memory device 14 displays an award for each winning hand of the final additional hands 181 and 182 according to the pay table 35. The amount of these awards can be displayed in any suitable manner such as being shown in the WIN location 26.

In one embodiment, the card game may also be a single hand card game instead of the multiple hand card game described above. In one embodiment, one of more jokers may be added to the standard fifty-two card deck so that card games using jokers may also be played.

A video poker machine is configured to allow a single player to play a poker card game comprising:

at least one input device;

at least one display device;

at least one processor; and at least one memory device which stores a plurality of instructions which, when executed by the at least one processor, cause the at least one processor to operate with the at least one display device and the at least one input device to:

a) establish a pay table associated with a final five card poker hand ranking;

b) establish an initial deck of playing cards to be used in the play of the poker game;

c) enable the player, using at least one input device, to make at least one wager on a five card poker hand;

d) after the player makes the at least one wager, activate a dream card indicator to determine if a dream card will be used during the play of the poker hand;

e) display to the player four cards face up representing a partial initial poker hand;

f) establish a first depleted deck of playing cards representing the initial deck of playing cards less the four cards of the partial initial poker hand;

g) if the dream card is used, select a fifth card from the first depleted deck and display the fifth card face up to the player so that the cards constitute an initial poker hand; the fifth card being selected so that the initial poker hand has the highest expected value;

h) enable the player, using at least one input device, to select none, one, a plurality or all of the face up cards from the initial poker hand as cards to be held;

i) discard from the first hand each card that was not held and display replacement cards in the poker hand for each card that was discarded thereby forming a final poker hand;

j) determine the poker hand ranking of the final poker hand; and k) make an award based on the pay table to the player if the final poker hand is a winning hand according to the pay table.

Also, a video poker machine is configured to allow a single player to play a poker card game comprising:

at least one input device;

at least one display device;

at least one processor; and at least one memory device which stores a plurality of instructions which, when executed by the at least one processor, cause the at least one processor to operate with the at least one display device and the at least one input device to:

a) establish a pay table associated with a final five card poker hand ranking;

b) establish an initial deck of playing cards to be used in the play of the poker game;

c) enable the player, using at least one input device, to make at least one wager on a five card poker hand;

d) after the player makes the at least one wager, display to the player four cards face up representing a partial initial poker hand;

e) establish a first depleted deck of playing cards representing the initial deck of playing cards less the four cards of the partial initial poker hand;

f) select a fifth card from the first depleted deck and display the fifth card face up to the player so that the cards constitute an initial poker hand; the fifth card being selected so that the initial poker hand has the highest expected value;

g) enable the player, using at least one input device, to select none, one, a plurality or all of the face up cards from the initial poker hand as cards to be held;

h) establish a second depleted deck of playing cards representing the initial deck of playing cards less the five cards of the initial poker hand;

i) discard from the first hand each card that was not held and display from the second depleted deck replacement cards in the poker hand for each card that was discarded thereby forming a final poker hand;

j) determine the poker hand ranking of the final poker hand; and k) make an award based on the pay table to the player if the final poker hand is a winning hand according to the pay table.

A method of operating a poker card game in which a single player plays against a pay table, the method comprising:

a) establishing a pay table associated with a final five card poker hand ranking;

b) establishing an initial deck of playing cards to be used in the play of the poker game;

c) the player making at least one wager on a five card poker hand;

d) after the player makes the at least one wager, activating a dream card indicator to determine if a dream card will be used during the play of the poker hand;

e) displaying to the player four cards face up representing a partial initial poker hand;

f) establishing a first depleted deck of playing cards representing the initial deck of playing cards less the four cards of the partial initial poker hand;

g) if the dream card is used, selecting a fifth card from the first depleted deck and displaying the fifth card face up to the player so that the cards constitute an initial poker hand; the fifth card being selected so that the initial poker hand has the highest expected value;

h) the player selecting none, one, a plurality or all of the face up cards from the initial poker hand as cards to be held;

i) establishing a second depleted deck of playing cards representing the initial deck of playing cards less the five cards of the initial poker hand;

j) discarding from the first hand each card that was not held and displaying from the second depleted deck replacement cards in the poker hand for each card that was discarded thereby forming a final poker hand;

k) determining the poker hand ranking of the final poker hand; and l) making an award based on the pay table to the player if the final poker hand is a winning hand according to the pay table.

Also, a method of operating a poker card game in which a single player plays against a pay table, the method comprising:

a) establishing a pay table associated with a final five card poker hand ranking;

b) establishing an initial deck of playing cards to be used in the play of the poker game;

c) the player making at least one wager on a five card poker hand;

d) displaying to the player four cards face up representing a partial initial poker hand;

e) establishing a first depleted deck of playing cards representing the initial deck of playing cards less the four cards of the partial initial poker hand;

f) selecting a fifth card from the first depleted deck and displaying the fifth card face up to the player so that the cards constitute an initial poker hand; the fifth card being selected so that the five card initial poker hand has the highest expected value;

g) the player selecting none, one, a plurality or all of the face up cards from the initial poker hand as cards to be held;

h) establishing a second depleted deck of playing cards representing the initial deck of playing cards less the five cards of the initial poker hand;

i) discarding from the first hand each card that was not held and displaying from the second depleted deck replacement cards in the poker hand for each card that was discarded thereby forming a final poker hand;

j) determining the poker hand ranking of the final poker hand; and k) making an award based on the pay table to the player if the final poker hand is a winning hand according to the pay table.

As discussed above in conjunction with FIG. 2B, in one embodiment a plurality of gaming devices or gaming machines 10 can be interconnected by a data network 58 to comprise a gaming system. The gaming system also would include at least one central controller; at least one processor; a plurality of gaming machines, each gaming machine having at least one input device and at least one display device; and at least one memory device which stores a plurality of instructions which, when executed by the at least one processor, cause the at least one processor to operate with the at least one display device and the at least one input device to carry out the method of play.

The use of a gaming system having a plurality of gaming devices or gaming machines interconnected allows for community play and tournament play among the various gaming machines, including progressive awards.

Although several of the examples in this disclosure focus on a Five Card Draw Video Poker game, it should be appreciated that the concepts described above may be applied to draw poker games that have more or less than five cards and to any gambling game that uses multiple game outcomes. Games with multiple game outcomes include multiple hand stud poker games and slot machines with multiple reels and multiple pay lines.

The invention is claimed as follows:

1. A video poker machine comprising:

a housing;

at least one input device supported by the housing and including a wager button and a cashout button;

an acceptor supported by the housing and configured to receive a physical item associated with a monetary value;

at least one display device supported by the housing;

at least one processor; and at least one memory device that stores a plurality of instructions that, when executed by the at least one processor, cause the at least one processor to operate with the at least one display device, the at least one input device, and the acceptor to:

(a) establish a credit balance based at least in part on the monetary value associated with the physical item responsive to receipt of the physical item by the acceptor;

(b) place a wager on a play of a card game responsive to an actuation of the wager button, the credit balance being decreasable by the wager;

(c) determine and display face-up a first hand including a plurality of cards;

(d) enable selection of none, one, a plurality, or all of the cards of the first hand to be held;

(e) display one or more additional hands each including any held cards of the first hand;

(f) if fewer than all of the cards of the first hand are held:

(1) discard each non-held card of the first hand;

(2) for each discarded card of the first hand, replace that discarded card with another card; and (3) for each of the one or more additional hands, add one or more cards to that additional hand such that that additional hand includes the same quantity of cards as the first hand, wherein responsive to a random activation of a dream card, the dream card is introduced into the first hand, wherein a suit and a value of the dream card is static and set based on at least one other card in the first hand to maximize an expected value of the first hand at the time the dream card is introduced into the first hand;

(g) afterwards, determine any awards for the hands, the credit balance increasable by any determined awards; and (h) initiate a payout associated with the credit balance responsive to an actuation of the cashout button.

2. The video poker machine of claim 1, wherein the plurality of instructions, when executed by the at least one processor, cause the at least one processor to randomly determine whether to activate the dream card responsive to satisfaction of a dream card condition.

3. The video poker machine of claim 2, wherein the dream card condition is satisfied when the wager is a designated wager.

4. The video poker machine of claim 1, wherein the plurality of instructions, when executed by the at least one processor, cause the at least one processor to randomly determine whether to activate the dream card before enabling selection of none, one, a plurality, or all of the cards of the first hand to be held.

5. The video poker machine of claim 4, wherein the plurality of cards of the first hand from which the at least one processor enables selection of none, one, a plurality, or all of the cards to be held:

(1) includes the dream card if the dream card is randomly activated; and (2) does not include the dream card if the dream card is not randomly activated.

6. The video poker machine of claim 5, wherein the plurality of instructions, when executed by the at least one processor, cause the at least one processor to, if the dream card is randomly activated and held, add the dream card to each additional hand.

7. The video poker machine of claim 1, wherein the dream card is not introduced into the first hand when the dream card is not randomly activated.

8. The video poker machine of claim 1, wherein the plurality of instructions, when executed by the at least one processor, cause the at least one processor to determine and operate with the at least one display device to display face-up the first hand including the plurality of cards by randomly determining at least one of the plurality of cards.

9. The video poker machine of claim 1, wherein the plurality of instructions, when executed by the at least one processor, cause the at least one processor to, if fewer than all of the cards of the first hand are held, for at least one discarded card, randomly select the other card to replace the at least one discarded card.

10. The video poker machine of claim 1, wherein the additional hands are associated with respective separate sets of cards, and the plurality of instructions, when executed by the at least one processor, cause the at least one processor to select cards to add to the additional hands from the respective separate sets of cards.

11. A method of operating a video poker machine, the method comprising:

(a) receiving, by an acceptor, a physical item associated with a monetary value;

(b) establishing, by at least one processor, a credit balance based at least in part on the monetary value associated with the received physical item;

(c) receiving an actuation of a wager button;

(d) placing, by the at least one processor, a wager on a play of a card game responsive to the actuation of a wager button, the credit balance being decreasable by the wager;

(e) determining, by the at least one processor, and displaying face-up, by at least one display device, a first hand including a plurality of cards;

(f) enabling selection of none, one, a plurality, or all of the cards of the first hand to be held;

(g) displaying, by the at least one display device, one or more additional hands each including any held cards of the first hand;

(h) if fewer than all of the cards of the first hand are held:

(1) discarding, by the at least one processor, each non-held card of the first hand;

(2) for each discarded card of the first hand, replacing, by the at least one processor, that discarded card with another card and displaying, by the at least one display device, the other card; and (3) for each of the one or more additional hands, adding, by the at least one processor, one or more cards to that additional hand such that that additional hand includes the same quantity of cards as the first hand and displaying, by the at least one display device, the one or more added cards, wherein responsive to a random activation of a dream card, the dream card is introduced into the first hand, wherein a suit and a value of the dream card is static and set based on at least one other card in the first hand to maximize an expected value of the first hand at the time the dream card is introduced into the first hand;

(i) afterwards, determining any awards for the hands, the credit balance increasable by any determined awards; and (j) initiating, by the at least one processor, a payout associated with the credit balance responsive to an actuation of a cashout button.

12. The method of claim 11, which includes randomly determining, by the at least one processor, whether to activate the dream card responsive to satisfaction of a dream card condition.

13. The method of claim 12, wherein the dream card condition is satisfied when the wager is a designated wager.

14. The method of claim 11, which includes randomly determining, by the at least one processor, whether to activate the dream card before enabling selection of none, one, a plurality, or all of the cards of the first hand to be held.

15. The method of claim 14, wherein the plurality of cards of the first hand from which the video poker machine enables selection of none, one, a plurality, or all of the cards to be held:

(1) includes the dream card if the dream card is randomly activated; and (2) does not include the dream card if the dream card is not randomly activated.

16. The method of claim 15, which includes, if the dream card is randomly activated and held, adding, by the at least one processor, the dream card to each additional hand.

17. The method of claim 11, which includes not introducing the dream card into the first hand when the dream card is not randomly activated.

18. The method of claim 11, which includes determining, by the at least one processor, and displaying face-up, by the at least one display device, the first hand including the plurality of cards by randomly determining at least one of the plurality of cards.

19. The method of claim 11, which includes, if fewer than all of the cards of the first hand are held, for at least one discarded card, randomly selecting, by the at least one processor, the other card to replace the at least one discarded card.

20. The method of claim 11, wherein the additional hands are associated with respective separate sets of cards, and which includes selecting, by the at least one processor, cards to add to the additional hands from the respective separate sets of cards.

* * * * *